United States Patent [19]

Waller

[11] Patent Number: 4,773,195

[45] Date of Patent: Sep. 27, 1988

[54] METHOD AND APPARATUS FOR FORMING A SLUICEWAY ADJACENT A WALL AND CEMENT FLOOR

[76] Inventor: Harvey Waller, Cherry La., Durham, Conn. 06422

[21] Appl. No.: 914,639

[22] Filed: Oct. 2, 1986

[51] Int. Cl.[4] ..... E04B 1/70; E04F 17/00

[52] U.S. Cl. ..... 52/169.5

[58] Field of Search ..... 52/169.5, 741

[56] References Cited

U.S. PATENT DOCUMENTS

| | | | |
|---|---|---|---|
| 3,017,722 | 1/1962 | Smith | 52/169.5 |
| 3,852,925 | 12/1974 | Gazzo | 52/169.5 |
| 4,185,429 | 1/1980 | Mendola | 52/169.5 |
| 4,245,443 | 1/1981 | Beechen | 52/169.5 |
| 4,538,386 | 9/1985 | Di Cello | 52/169.5 |

*Primary Examiner*—Alfred C. Perham

*Attorney, Agent, or Firm*—McCormick, Paulding & Huber

[57] ABSTRACT

A method and related apparatus for forming a sluiceway adjacent a wall and cement floor includes a sluiceway form made from a generally rectangular sheet of biodegradable material having a number of generally parallel fold lines to define a plurality of contiguous sluiceway panels disposed inwardly of opposite marginal portions of the sheet which are folded into face-to-face relation with each other to form an elongated sluiceway form having a body portion defined by the sluiceway panels and a tab defined by the marginal portions projecting from the body portion and extending along the entire length of the body portion. The sluiceway is formed by positioning the sluiceway form adjacent the wall with at least a part of the body portion below the level of the grade and the free edge of the tab extending in a generally parallel relation to the grade level. The tab is secured to the wall and the concrete floor is poured with the sluiceway form in position. The sluiceway form may be removed or left in place to disintegrate.

10 Claims, 1 Drawing Sheet

METHOD AND APPARATUS FOR FORMING A SLUICEWAY ADJACENT A WALL AND CEMENT FLOOR

BACKGROUND OF THE INVENTION

The present invention relates generally to concrete structure formation and deals more particularly with a method and related apparatus for forming a sluiceway at the juncture between a cement wall and floor for capturing and routing fluid to a sump drain or the like.

A below ground level concrete structure, such as, for example, the basement of a house or other building wherein concrete is poured subsequent to the formation of the surrounding walls to form a floor, is, often plagued by the infiltration of ground water especially, at the intersection of the wall and the floor. Such water infiltration subjects any items in the basement area to water dammage and effectively renders the area unsuitable for any reasonable use.

One solution to the problem is to divert any water beneath the floor and behind the wall away from the basement area by installing a network of sub-surface drains which are usually enclosed in crushed stone or other suitable material and which drains collect and carry any sub-surface water away from the structure or sometimes direct the water to a sump drain. The above-described solution is generally costly, adds to the construction time and in many instances the drains are not needed. Unfortunately, the need for such drains is generally not predictable and the drains may or may not be included. If not needed, an unnecessary expense is added to the cost of construction.

If drains are needed but not installed, subsequent procedures and the methods to install such drains are expensive and generally require breaking up the concrete floor to gain access to the area beneath the floor to install a network of drains to collect and carry water to a sump drain.

Another solution is to provide a channel in the floor surface along the perimeter of the floor and adjacent to the wall. One commonly used method to create such a channel requires placing a piece of elongated lumber generally having a dimension 2"×4" (two inches by four inches), along the perimeter of the floor area adjacent the wall prior to pouring the concrete floor so that when the floor is poured, the concrete is prevented from coming in contact with the wall but instead comes in contact with the lumber. The lumber is removed after the concrete has dried to leave behind a channel in its place and which channel may be directed to a sump drain or the like.

The use of a piece of lumber as described above to form a channel has many drawbacks and disadvantages thus is not acceptable as a practical alternative to more expensive drain installations. One drawback is that cement generally expands during drying and compresses the lumber between the floor and the wall making it extremely difficult to remove. Oftentimes, the lumber must be chopped or chiseled out thus destroying the piece of lumber. Such removal is labor intensive and adds to the construction expense and time.

A further drawback is that a channel formed using the foregoing method must be at the grade level of the floor surface leaving the channel opening exposed. In some instances, it is desirable to provide a channel below the surface of the floor for example, if it is desired to "finish-off" or otherwise make living quarters in a basement area.

A general object of the present invention is therefore, to provide a method and related apparatus for forming a sluiceway between a wall and a cement floor to capture and route fluid to a sump drain or the like which overcomes the drawbacks of previously used methods and apparatus.

A further object of the present invention is to provide a sluiceway form that is fabricated from a biodegradable material which permits the form to disintegrate when it is left in place between the wall and cement floor.

A further object of the present invention is to provide a sluiceway form using a biodegradable sheet material that is lightweight, storable and easily transported to a construction site.

Additional objects, features and advantages of the present invention will become readily apparent from the following written description of a preferred embodiment and the drawings forming a part thereof.

SUMMARY OF THE INVENTION

The present invention resides in a method and related apparatus for forming a sluiceway adjacent a wall and cement floor at or below the grade level of the surface of the cement floor. A sluiceway form is made from a generally rectangular sheet of biodegradable material which has a number of generally parallel fold lines to define a plurality of contiguous sluiceway panels disposed inwardly of opposite marginal portions of the sheet. The opposite marginal portions are folded into face-to-face relation with each other to form an elongated sluiceway form. The sluiceway form has a body portion defined by the sluiceway panels and a tab defined by the marginal portions projecting from the body portion and extending along the entire length of the body portion. The sluiceway is formed in the concrete by positioning the sluiceway form adjacent the wall with at least a part of the body portion below the level of the grade and the free edge of the tab extending in a generally parallel relation to the grade level. The tab is secured to the wall and the concrete floor is poured with the sluiceway form in position.

The sluiceway form is removable after the concrete floor has dried by pulling the form out by the tab. Alternately, the form may be left in place to disintegrate.

DETAILED DESCRIPTION OF A PREFERRED EMBODIMENT

Figure 1:
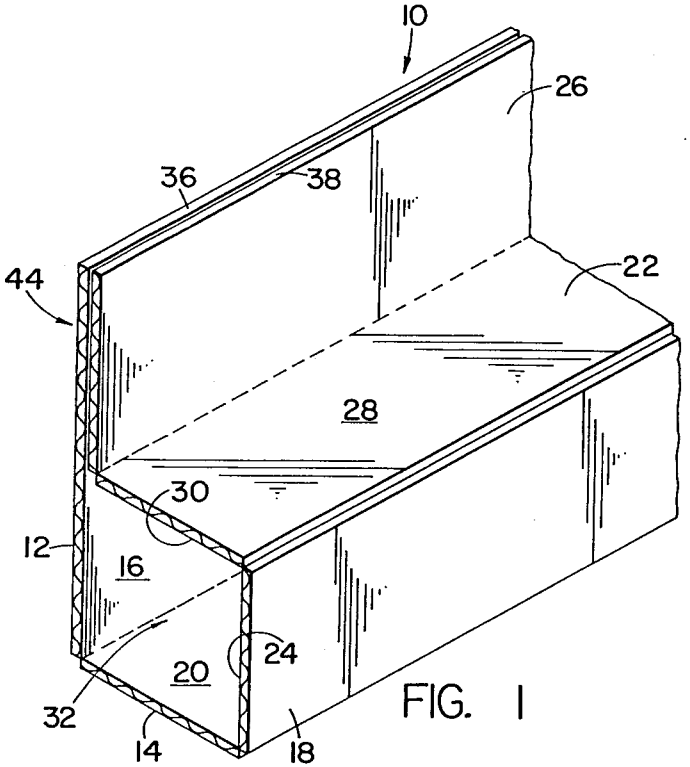
FIG. 1 is a perspective view of the sluiceway form embodying the present invention.
Figure 2:
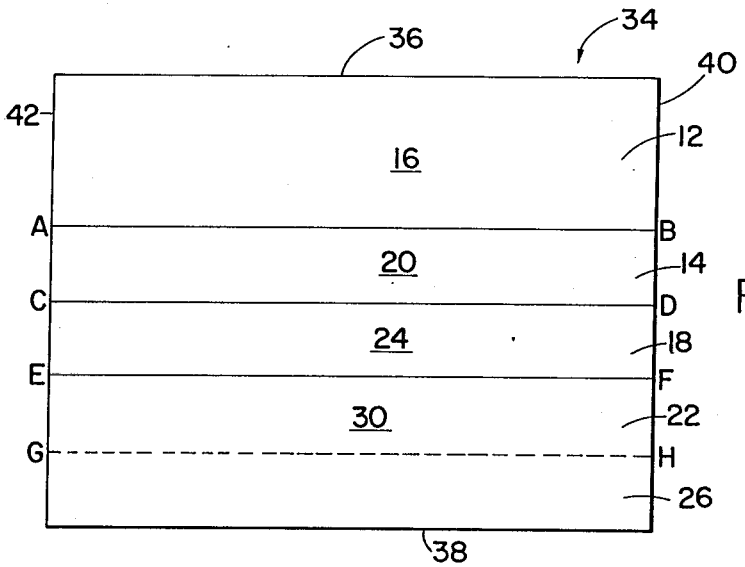
FIG. 2 is a plan view of the top surface of the sheet material used in the sluiceway form of FIG. 1 showing the contiguous panels defined by the parallel fold lines.
Figure 3:
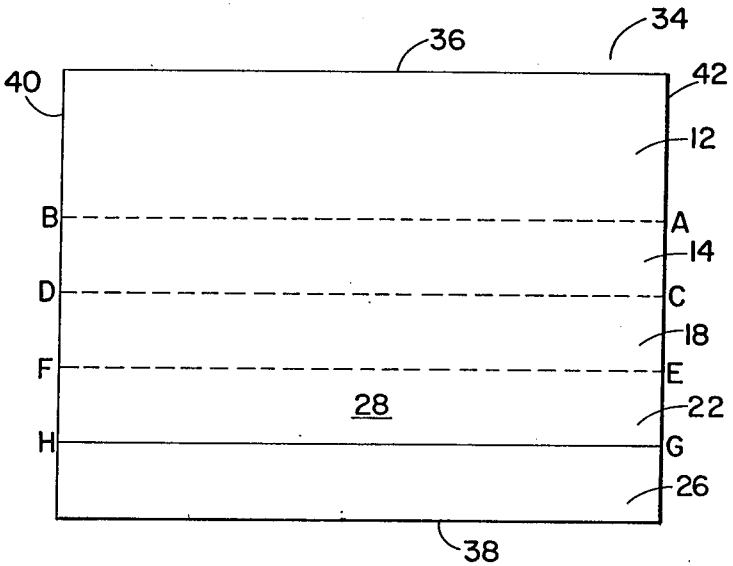
FIG. 3 is a plan view of the bottom surface of the sheet material of FIG. 2 again showing the contiguous panels defined by the parallel fold lines.

Turning now to the drawings and considering FIGS. 1, 2 and 3 inparticular, a preferred embodiment of a sluiceway form generally designated 10 is shown in a perspective and fragmentary view in FIG. 1. The sluiceway form 10 comprises a number of contiguous sluiceway panels including a rear panel 12 having an inner surface 16, a bottom panel 14 having an inner surface 20 and extending substantially perpendicular to the inner surface 16 of the rear panel 12, a front panel 18 having an inner surface 24 and extending substantially perpendicular to the inner surface 20 of the bottom panel 14 and substantially parallel with the rear panel 12. An upper panel 22 extends substantially perpendicular to the inner surface 24 of the front panel 18 and substantially parallel with the bottom panel 14 and in a direction toward the rear panel 12. A tab panel 26 extends substantially perpendicular to the outer surface 28 of the upper panel 22 in a direction away from the bottom panel 14 and substantially parallel to and in proximity with the inner surface 16 of the rear panel 12. The upper panel 22 includes an inner surface 30 and together with the inner surfaces 16, 20 and 24 define an elongated channel 32 therebetween.

The sluiceway form 10 may be fabricated from any suitable sheet material. Preferably, the sheet material is of the type generally referred to a corrogated cardboard because of its widespread availability, resiliancy, lightweight and because it is biodegradable. Furthermore, the surface of the corrogated cardboard may be easily and accurately cut for forming the parallel fold lines defining the contiguous panels which when folded as explained herein below result in the sluiceway form 10 illustrated in FIG. 1.

Referring to FIGS. 2 and 3, a sheet 34 of corrogated cardboard material is illustrated and includes edges 36 and 38 substantially parallel to one another and in a spaced apart relationship with each other. Sides 40 and 42 are substantially parallel to one another and in a spaced apart relationship and generally perpendicular to the edges 36 and 38. The rear panel 12 is defined in FIG. 2 as the area between the edge 36 and the fold line A-B extending between the sides 40,42. As illustrated in FIG. 2, the panel 14 is defined as the area between the fold line A-B and a fold line C-D extending between the sides 40 and 42 and substantially parallel with the line A-B. The panel 18 is defined as the area between the fold line C-D and a fold line E-F extending between the sides 40 and 42. In a similar manner, the panel 22 is defined by the area between the fold line E-F and the cut line G-H extending between the sides of 40 and 42. The panel 26 is defined by the area between the cut line G-H and the bottom edge 38. The sheet material is weakened along the fold lines to facilitate folding the sheet into the sluiceway form 10. The sheet material upper surface is cut along the line G-H in FIG. 2 to form a fold line G-H on the bottom surface as illustrated in FIG. 3. Cut lines A-B, C-D and E-F are made in the lower surface of the sheet material as illustrated in FIG. 3 to form the fold lines A-B, C-D and E-F in the upper surface of the sheet material as shown in FIG. 2. In this manner, the panels forming the sluiceway form are integrally connected to an adjacent panel and consequently the sheet material 34 can be stacked, stored and transported in a convenient bundle.

Considering FIGS. 1, 2 and 3, the sluiceway form 10 is produced by folding the sheet material 34 along the fold lines as follows. The outer marginal panel 12 is folded along the fold line A-B into a vertical relationship with the panel 14 integrally connected to the panel 12 along the top surface of the sheet material, the bottom surface of the sheet material separating along the cut line A-B. The panel 14 is integrally connected to the panel 18 along the top surface and is folded into vertical relationship with the panel 14 along the fold line C-D of the top surface of the sheet material 34, the bottom surface separating along the cut line C-D. Panel 22 is integrally connected to panel 18 along the top surface of the sheet material 34 and is folded into a horizontal relationship with panel 14 along the fold line E-F, the bottom surface of the sheet material separating along the cut line E-F. Tne opposite marginal panel 26 is folded along the fold line G-H of the bottom surface of the sheet material 34, the top surface separating along the line G-H such that the panel 26 is in a vertical relationship with the panel 22 and in a face-to-face relationship with the panel 12. The face-to-face relationship of the panel 26 and the panel 12 form a tab generally designated 44 which tab is used to secure the sluiceway form 10 adjacent a wall as explained below.

Figure 4:
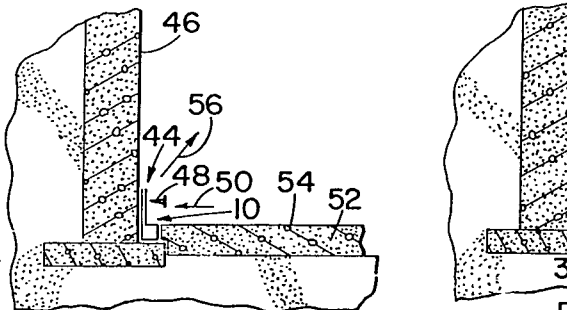
FIG. 4 is a somewhat schematic cross-sectional view of a cement wall and floor wherein the sluiceway form is positioned adjacent the wall to provide a sluiceway at grade level.
Figure 5:
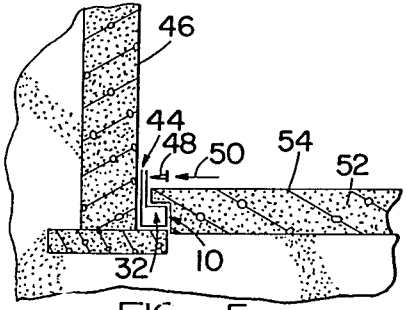
FIG. 5 is a somewhat schematic cross-sectional view of a cement wall and floor wherein the sluiceway form is positioned adjacent the wall to provide a sluiceway below grade level.

Considering now FIGS. 4 and 5, FIG. 4 illustrates the placement of the sluiceway form 10 adjacent a cement wall 46 wherein a nail or other suitable fastener 48 is driven through the tab portion 44 into the wall 46 in the direction of arrow 50 to hold the sluiceway form in place. As ilustrated in FIG. 4, the sluiceway form is positioned such that concrete poured to form a cement floor 52 such that its upper surface 54 is kept away from the wall 46 by the sluiceway form. Once the concrete has dried, the form 10 is removed by pulling out the nails 48 and pulling the tab 44 in the direction of arrow 56 leaving a sluiceway between the floor 52 and the wall 46. In cases where concrete may splash onto the sluiceway form 10 and form a skin, the skin is easily broken to allow the sluiceway form to be removed. It will be readily seen that any fluid deposited on the surface 54 of the floor 52 or infiltrating through the wall 46 will be captured in the sluiceway between the floor and the wall. The sluiceway may be directed to a sump drain or the like adjacent the perimeter of the wall 46.

Considering FIG. 5, a sluiceway may be formed below the surface 54 of the concrete floor 52 by pouring the concrete to cover the panels forming the channel 32 of the sluiceway form 10 so that a portion of the tab 44 is left exposed which prevents the concrete from coming into contact with the wall 46. After the concrete has dried, a portion of the tab 44 may be cut away to provide communication between the upper surface 54 of the cement floor 52 and the sluiceway remaining as a result of the sluiceway form 10. Consequently, it can be seen that any fluid deposited on the surface 54 or infiltrating through the wall 46 will flow into the sluiceway through the slight gap left by the removal of the tabl 44. The remaining material of the sluiceway from 10 will disintegrate over a period of time since the material of the sluiceway form is biodegradable.

A number of sluiceway forms 10 may be placed lengthwise in an end-to-end fashion or may be cut at the work site to produce a desired length sluiceway.

A method and related apparatus for forming a sluiceway adjacent a wall and a cement floor has bee described in a preferred embodiment however, it will be appreciated that numerous changes and modifications may be had without departing from the scope and spirite of the invention. Consequently, the invention has been described by way of illustration rather than limitation.

I claim:

1. A method for making a concrete basement structure or the like having a wall, a floor, and a sluiceway formed in the structure, said method comprising the steps of:

folding a generally rectangular sheet of biodegradable material along generally parallel fold lines to define a plurality of contiguous sluiceway panels disposed inwardly of opposite marginal portions of the sheet;

folding the sheet to bring said opposite marginal portions into face-to-face relation with each other to form an elongated sluiceway form having a sluiceway body portion defined by said sluiceway panels and a tabl defined by said marginal portions projecting from said sluiceway body portion and extending along the entire length of said sluiceway body portion, said tab having a free edge generally parallel to and extending the length of said body portion;

positioning said sluiceway form adjacent said wall with at least part of said body portion below the grade level of said concrete floor grade and said free edge of said tab extending in generally parallel relation to said grade level;

securing said tab to said wall;

pouring said concrete floor with said sluiceway form in position adjacnet said wall, and disintegrating said sluiceway form material to permit said sluiceway formed adjacent said wall and floor to collect and carry away water entering said sluiceway.

2. The method of claim 1 further including the step of positioning any number of sluiceway forms in an end-to-end, lengthwise fashion to produce an elongated sluiceway form of any desired length and configuration.

3. The method of claim 1 wherein the steps of positioning said sluiceway form adjacent said wall includes the step of positioning said body portion entirely below the level of said grade and said free edge of said tab above the level of said grade.

4. The method of claim 3 further including the step of removing said tab positioned between said wall and said concrete floor to provide a means of communication between the surface of the concrete floor and the sluiceway formed below said grade of said concrete floor.

5. The method of claim 1 wherein the step of securing said sluiceway tab to said wall includes the step of nailing said tab to said wall.

6. The method of claim 1 further including the step of providing a sump drain below said sluiceway and in intersecting relation with said sluiceway.

7. The method of claim 1 wherein the step of folding the sheet material along parallel fold lines further includes the step of weakening the biodegradable material coincident with the fold lines.

8. In combination with a wall and a cement floor, a sluiceway form adjacent to said wall at grade level wherin said cement floor is poured with said sluiceway form in position, said sluiceway form comprising:

a generally rectangular sheet of biodegradable material having a number of generally parallel fold lines to define a plurality of contiguous sluiceway panels, said sheet material having a thickness, a first surface and a second surface disposed opposite said first surface, said panels being substantially free of openings extending through the thickness of the sheet material and between said first and second surfaces;

a first opposite marginal panel being at least twice the width of the other sluiceway panels;

said sluiceway panels disposed inwardly of opposite marginal panels, said first marginal panel integrally connected to a second panel along a first fold line, said first marginal panel folded along said first fold line into a vertical relation with said second panel;

said second panel integrally connected to a third panel along a second fold line, said third panel folded along said second fold line into a vertical relation with said second panel;

said third panel integrally connected to a fourth panel along a third fold line, said fourth panel folded along said third fold line into a horizontal relation with said third panel and a parallel relation with said second panel, and said fourth panel integrally connected with a second marginal panel along a fourth fold line, said second marginal panel folded along said fourth fold line into a vertical relation with said fourth panel and into a face-to-face relation with said first marginal panel.

9. The method of claim 4 further characterized in that the step of removing said tab to provide a means of communication between said wall and said concrete floor includes providing a gap having a lateral dimension substantially smaller than the lateral dimension of said body portion of said sluiceway form.

10. A method for making a concrete basement structure or the like having a wall, a floor, and a sluiceway formed in the strcuture below the grade level of said concrete floor, said method comprising the steps of:

folding a generally rectangular sheet of corrugated cardboard along generally parallel fold lines to define a plurality of contiguous sluiceway panels disposed inwardly of opposite marginal portions of the sheet;

folding the sheet to bring said opposite marginal portions into face-to-face relation with each other to form an elongated sluiceway form having a sluiceway body portion defined by said sluiceway panels and a tab defined by said marginal portions projecting from said sluiceway body portion and extending along the entire length of said sluiceway body portion, said tab having a free edge generally parallel to and extending the length of said body portion;

positioning said sluiceway form adjacent said wall with said body portion below the grade level of said concrete floor and said free edge of said tab above said grade level, said free edge of said tab extending in generally parallel relation to said grade level;

securing said tab to said wall;

pouring said concrete floor with said sluiceway form in position adjacent said wall;

removing said tab positioned between said wall and said concrete floor to provide a means of communication between the surface of said concrete floor and said sluiceway formed below said grade level of said concrete floor, wherein said step of removing said tab includes providing a gap between said wall and said concrete floor, said gap having a lateral dimension substantially smaller than the lateral dimension of said body portion of said sluiceway form, and disintegrating said corrugated cardboard sluiceway form to permit said sluiceway formed adjacent said wall and floor to collect and carry away water entering said sluiceway.

* * * * *